United States Patent [19]

Sukai

[11] Patent Number: 4,880,214

[45] Date of Patent: Nov. 14, 1989

[54] CUSHIONING AND PROTECTING MEMBERS

[75] Inventor: Emiko Sukai, Chigasaki, Japan

[73] Assignee: Kabushiki Kaisha Toshiba, Kanagawa, Japan

[21] Appl. No.: 28,402

[22] Filed: Mar. 20, 1987

[30] Foreign Application Priority Data

Mar. 29, 1986 [JP] Japan ..... 61-46437[U]
Aug. 29, 1986 [JP] Japan ..... 61-203136

[51] Int. Cl.[4] ..... F16M 1/00; F16F 1/36; B65D 85/30; F16L 41/00

[52] U.S. Cl. ..... 267/136; 206/594; 206/814; 403/194; 428/137; 267/153

[58] Field of Search ..... 267/136, 152, 153, 141, 267/141.1, 166, 167, 248, 286, 292, 80, 140.3; 188/376, 377, 268; 206/521, 523, 584, 814, 583, 594; 493/967; 217/52–55; 428/35, 137; 403/194, 195, 201

[56] References Cited

U.S. PATENT DOCUMENTS

| | | | |
|---|---|---|---|
| 1,538,737 | 5/1925 | O'Flynn | 267/136 X |
| 1,808,136 | 6/1931 | Gray | 206/521 |
| 3,195,686 | 7/1965 | Johnson | 267/80 X |
| 3,226,285 | 12/1965 | Iovenko | 217/53 |
| 3,327,041 | 6/1967 | Clune et al. | 217/55 X |
| 3,356,209 | 12/1967 | Pezely, Jr. | 206/523 |
| 3,399,797 | 9/1968 | Freeman | 217/52 |
| 3,546,055 | 12/1970 | Spertus | 267/141 X |
| 3,667,593 | 6/1972 | Pendleton | 217/53 X |
| 3,701,465 | 10/1972 | Richter | 206/521 |
| 4,287,265 | 9/1981 | McKnight | 267/140.3 |

FOREIGN PATENT DOCUMENTS

| | | | |
|---|---|---|---|
| 2140728 | 2/1972 | Fed. Rep. of Germany | 267/152 |
| 1207269 | 2/1960 | France | 267/141 |
| 1176112 | 8/1985 | U.S.S.R. | 267/136 |

*Primary Examiner*—Robert J. Oberleitner
*Attorney, Agent, or Firm*—Finnegan, Henderson, Farabow, Garrett & Dunner

[57] ABSTRACT

A cushioning and protecting member for cushioning and protecting articles packed in a case is provided that includes a plurality of cushions having a variety of shapes and which can be compressed by pressure. The protecting member further includes a supporting plate which attachably or detachably supports the cushions. The cushions are compressed from a state in which they are in contact with the article or case body and, further, the cushions can be attached and detached from the supporting plate to thereby facilitate re-use of the cushions.

3 Claims, 10 Drawing Sheets

CUSHIONING AND PROTECTING MEMBERS

FIELD OF THE INVENTION AND RELATED ART STATEMENT

The present invention relates to cushioning and protecting members to protect an article from external shock in which the article such as electronic equipment or the like is accommodated.

Conventionally, as cushioning and protecting members which accommodate and protect an article such as electronic equipment, the following member has been known.

Conventional cushioning and protecting members for an article are constituted by accommodating the article in a case body which is formed into a box shape with corrugated fibreboard, and interposing a cushioning member between the article and the case body.

The cushioning member includes a plurality of cushioning means which are formed to a cubic shape by means of a foam-plastic body having flexibility and made of foamed polyurethane or the like and, a supporting plate formed by corrugated fibreboard or the like, which is capable of sticking to these cushioning means by means of adhesives.

In the cushioning and protecting members, the article to be accommodated in the case body and to be protected therein is supported by a cushioning member which interposed between the article and the case body. Accordingly, the article is adapted to be protected from shock during transportation.

However, in the conventional packaging container for an article constituted in such a manner, since the cushioning means are stuck to the supporting plate by, adhesives for example there is a disadvantage in that the work requires much time and an increase in cost is introduced. Further, since the flat portions of the cushioning means contact the article, the cushioning property is low, namely, the compressed volume of the cushioning means is small. Therefore, the surplus force due to shock from the outside is liable to be transferred to the article, and thus there is a disadvantage in that the article is damaged. Further, since the cushioning means are stuck to the supporting plate, there is a disadvantage in that it is impossible to reuse the cushioning member for another article.

OBJECT AND SUMMARY OF THE INVENTION

An object of the present invention is to provide cushioning and protecting members for an article with a simple structure that can be simply and cheaply manufactured.

A further object of the present invention is to provide cushioning and protecting members which enable cushioning means to attached and detached at the given places and any place on a supporting means.

Another object of the present invention is to provide cushioning and protecting members which enable the cushioning means to contact at least the article or a case body at the approximate point contacts to improve the cushioning property.

Another object of the present invention is to provide cushioning and protecting members which enable the supporting body to be attached and detached to support the cushioning means for use and for reuse, and at any place.

Accordingly, the cushioning and protecting members of the present invention includes a plurality of cushioning means occupied with given spaces for being compressed by pressure, and a supporting means with a flat section and to which a part of these cushioning means can be attached and detached.

And according to the present invention, it is possible to cause the cushioning means to be easily supported by the supporting plate, with a simple structure, by means of the above, and it is also possible to greatly reduce manufacturing cost, and further it is possible to greatly improve the cushioning property.

DETAILED DESCRIPTION OF PREFERRED EMBODIMENTS

The present invention will, hereinafter, be described in connection with the embodiments while referring in detail to the accompanying drawings.

Figure 1:
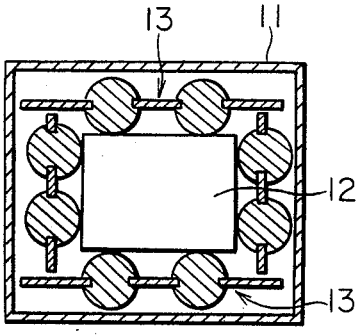
FIG. 1 is a partial sectional plan view showing cushioning and protecting members of the first embodiment of the present invention.

FIG. 1 is a sectional view showing the first embodiment of the present invention.

In FIG. 1, in a case body 11 which is formed into a box by means of, for example, corrugated fibreboard, with a cushioning member 13 interposed between the article 12 to be accomodated and to be protected and the case body 11.

Figure 2:
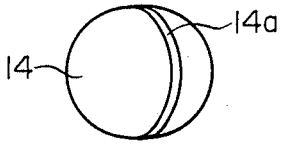
FIG. 2 is a perspective view showing the cushioning means of FIG. 1.
Figure 3:
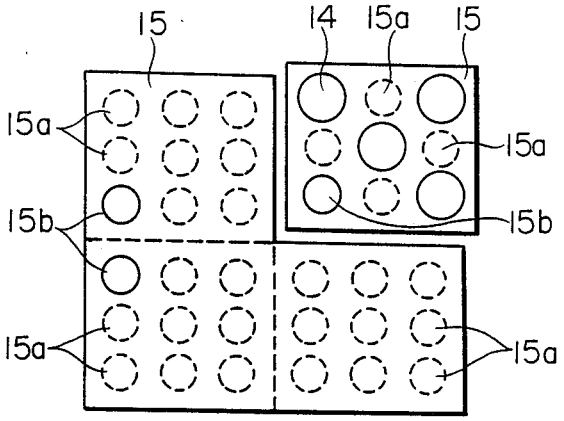
FIG. 3 is a plan view showing the cushioning member of FIG. 1.

So as to support a spherical cushioning means 14 which has an engaging groove 14*a*, at the respective given places, as shown in FIG. 2, the cushioning member 13 mentioned above, as shown in FIG. 3, is constituted by eliminating perforations 15*a* in the given places of a supporting plate 15 which is formed by, for example, a corrugated fibreboard plate, a veneer board and a plastic plate or the like and which is formed with a plurality of perforations 15*a* for forming punched holes to form the punched holes 15*b* and engaging the engaging grooves 14*a* of the cushioning means 14 with these punched holes 15*b*. Further, the supporting plate 15 can be used separately, corresponding to the size of the article, as shown in FIG. 3. Furthermore, the cushioning means 14 is formed by a plastic formed body, a rock cushioning member, rubber and cork or the like.

Accordingly, in this embodiment, the article 12 is accommodated in the case body 11 and the cushioning member 13 with the supporting plate 15 for supporting the spherical cushioning means 14 is interposed between the article 12 and the case body 11 to be a state to cause the cushioning means 14 to make approximate point-contact with the article 12. And when an external shock is applied to the case body 11, the shock is excellently absorbed because the cushioning means 14 are compressed to convert point contact into surface contact.

Figure 4:
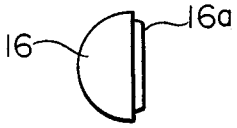
FIG. 4 is a side view showing the cushioning means of the second embodiment of the present invention.
Figure 5:
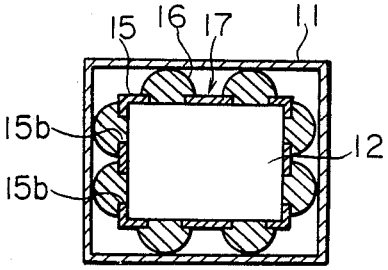
FIG. 5 is a partial sectional plan view showing the cushioning and protecting members for an article which use the cushioning means of FIG. 4 of the second embodiment of the present invention.

FIGS. 4 and 5 are views showing the second embodiment of the present invention. In this embodiment, as shown in FIG. 4, by using hemispherical cushioning means 16 which are made of, for example, the plastic foamed body, the rock cushioning member, rubber and cork or the like and which are formed with a step portion 16*a*, the step portions 16*a* of the cushioning means 16 are engaged with the circular punched holes 15*b* of the supporting plate 15 which is formed by, for example, the corrugated fibreboard plate, the plastic plate and the veneer board or the like constitute the cushioning member 17, and the cushioning member is interposed between the case body 11 and the article 17.

Accordingly, also in this embodiment, it is possible to cause the cushioning means 16 to be easily supported by the supporting plate 15 and thus it is possible to greatly improve the cushioning property.

Figure 6:
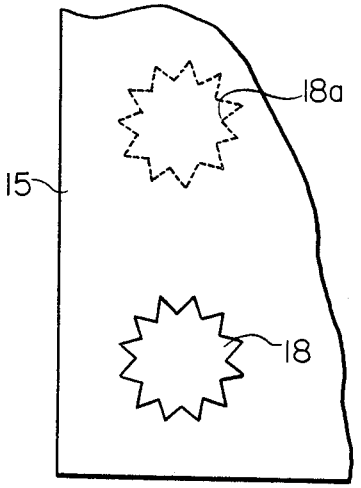
FIG. 6 is a plan view showing the supporting plate of the third embodiment of the present invention.

FIG. 6 is a view showing the supporting plate of the cushioning member of the third embodiment of the present invention. In this embodiment, for example, a V-shaped or U-shaped or polygonal projections 18*a* are formed in the perforation formed in the supporting plate 15 which is made of, for example, the corrugated fibreboard plate or the plastic plate or the like to form the punched hole 18 having the projections.

Whereby, in this embodiment, it is possible to cause the cushioning means to be securely supported the supporting plate.

Figure 7:
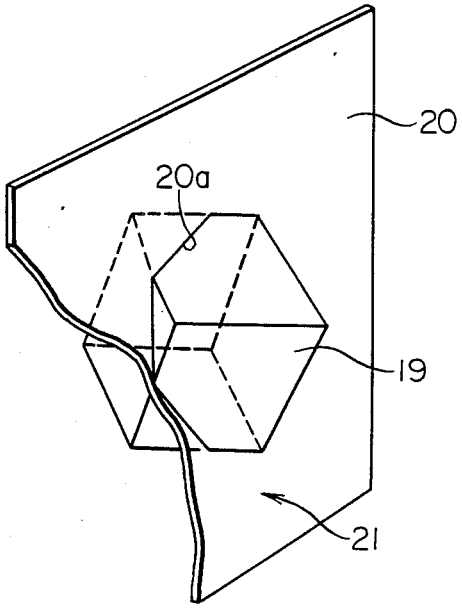
FIG. 7 is a partial sectional perspective view showing the cushioning member of the fourth embodiment of the present invention.
Figure 8:
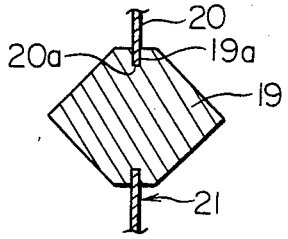
FIG. 8 is a sectional side view of FIG. 7.

FIGS. 7 and 8 are views showing the cushioning member of the fourth embodiment of the present invention. In this embodiment, the cushioning means is formed into a polyhedral shape such as a cube made of, for example, the plastic foamed body, the rock cushioning member, rubber and cork or the like, and grooves 19*a* are formed in its outer periphery in which the apexes of the cushioning means 19 are directed to both outer sides. And after the punched hole 20*a* of the supporting plate 20 which is formed by, for example, the corrugated fibreboard plate, the plastic plate and the veneer board or the like are matched to the shape of the cushioning means 19 or are formed into an optional shape, the cushioning means 19 is engaged with the punched hole 20*a*.

And as shown in FIG. 8, the cushioning member 21 is constituted by engaging the grooves 19*a* with the punched hole 20*a* of the supporting plate 20 so as to cause the opposite apexes of the cushioning means 19 to be directed to both outer sides.

And the cushioning means 21 is used by causing it to interpose between the case body and the article, similar to the embodiment mentioned above.

Accordingly in this embodiment, since the article is supported by the apexes of the cushioning means 19, it is possible to obtain an optional cushioning property by optionally selecting the shape of the polyhedron of the cushioning means 19, and thus it is possible to effectively prevent an external force which is given to the article.

Figure 9:
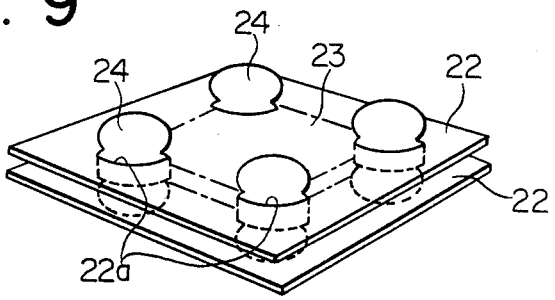
FIG. 9 is a perspective view showing the fifth embodiment of the present invention.
Figure 10:
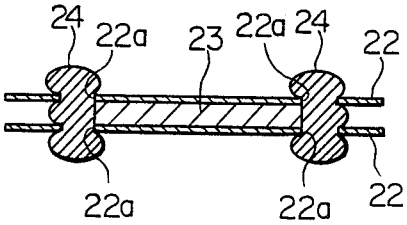
FIG. 10 is a sectional side view of FIG. 9.

FIGS. 9 and 10 are views showing the fifth embodiment of the present invention. In this embodiment, the article 23 is sandwiched by two supporting plates 22, 22 which are formed by, for example, the corrugated fibreboard plate, the article is secured by engaging the cushioning means 24 which are made of, for example, the plastic foamed body, the rock cushioning member, rubber and cork or the like with the opposite punched holes 22*a*, 22*a* of the supporting plates 22, respectively.

Whereby, in this embodiment, it is possible to support the article and to protect it from shock without using the case body. Further, a plurality of the supporting plates which support these articles and the cushioning means may be piled up in the case body to accommodate them.

Figure 11:
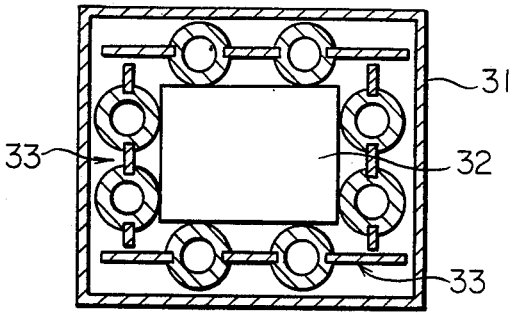
FIG. 11 is a partial sectional plan view showing the sixth embodiment of the present invention.

FIG. 11 is a view showing the sixth embodiment of the present invention. In FIG. 11, reference numeral 31 designates the case body which is formed into a box by, for example, the corrugated fibreboard plate. In the case body 31, the cushioning member 33 is interposed between the article 32 to be accommodated and to be protected and the case body 31.

Figure 12:
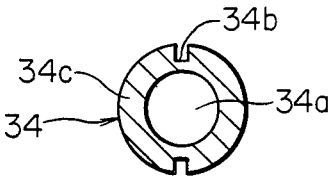
FIG. 12 is a sectional view showing the cushioning means of FIG. 11.
Figure 13:
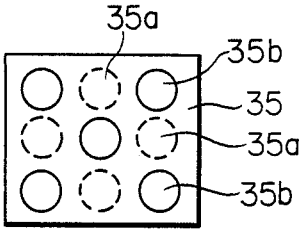
FIG. 13 is a front view showing the supporting plate of FIG. 11.
Figure 14:
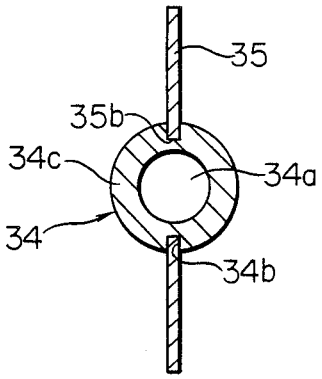
FIG. 14 is a sectional view showing the cushioning member of FIG. 11.

In the cushioning member 33 mentioned above, so as to support a spherical cushioning means 34, as shown in FIG. 12, which is formed by, for example, the plastic foamed body, the rock cushioning means and rubber or the like, inside of which a spherical cavity portion 34*a* is formed and in the outer periphery of which the engaging groove 34*b* is formed. In the given places, the perforations 35*a* in the given places of the supporting plate 35 which is made of, for example, corrugated fibreboard plate and which is formed with a plurality of circular perforation 35*a* for forming the punched holes are eliminated to form the punched holes 35*b*, and as shown in FIG. 14, the engaging groove 34 of the cushioning means 34 is engaged with each punched hole 35*b*. Further, the punched hole 35*b* may be a simple punched hole without perforations.

Further, it is possible to change the cushioning property of the cushioning means 34 by changing the size of the cavity portion 34*a* of the cushioning means 34 and the internal pressure. Furthermore, a filler such as a gel-like liquid having the cushioning property may be filled into the cavity portion 34*a*.

And in this cushioning and protecting members, when the article 32 is accommodated within the case body 31, the article 32 is accommodated and protected by interposing the cushioning member comprising the spherical cushioning means 34 with the cavity portion 34*a* and the supporting plate 35 for supporting the spherical cushioning means between the article 32 and the case body 31.

Accordingly, in this embodiment, since the cushioning member 33 is composed by the cushioning means 34 having the spherical cavity portion 34*a* in the inside and the supporting plate 35 for supporting the spherical cavity portion, the cushioning property of the cushioning member 33 is greatly improved and thus it is possible to effectively absorb external shock. Further, even if the article 32 is light-weight or even if the article is heavy, it is possible to obtain optional cushioning property by changing the size of the cavity portion 34*a* of the cushioning means 34, or the shape and the internal pressure of a filler such as gas and liquid as mentioned above.

Figure 15:
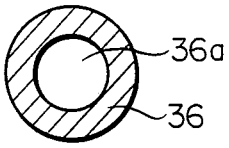
FIG. 15 is a sectional view showing the cushioning means of the seventh embodiment of the present invention.
Figure 16:
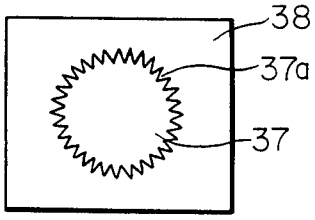
FIG. 16 is a front view showing the supporting plate of the seventh embodiment of the present invention.
Figure 17:
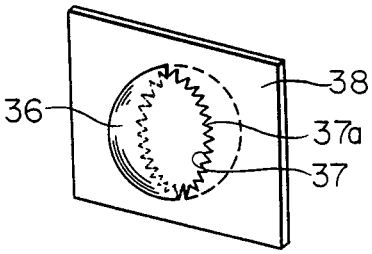
FIG. 17 is a perspective view showing the cushioning member of the seventh embodiment of the present invention.

FIGS. 15 to 17 are views showing the cushioning member of the seventh embodiment of the present invention. In this embodiment, the spherical cushioning means 36, as shown in FIG. 15, which is formed by, for example, a plastic foamed body, a rock cushioning means and rubber and inside of which the spherical cavity portion 36*a* is formed and supported by the supporting plate 38 shown in FIG. 16 which is formed, for example, by a corrugated fibreboard plate, the plastic plate and the veneer board or the like and in which the polygonal punched hole 37 having V-shaped or U-shaped projections 37*a* is formed, by engaging the outer periphery of the cushioning means 36 with the punched hole 37 of the supporting plate 38, as shown in FIG. 17.

Whereby, in this embodiment, even if the groove or the slot is not formed in the cushioning means, it is possible to easily and securely support the cushioning means in the supporting plate.

Figure 18:
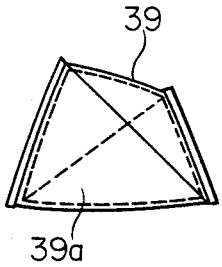
FIG. 18 is a perspective view showing the cushioning means of the eighth embodiment of the present invention.
Figure 19:
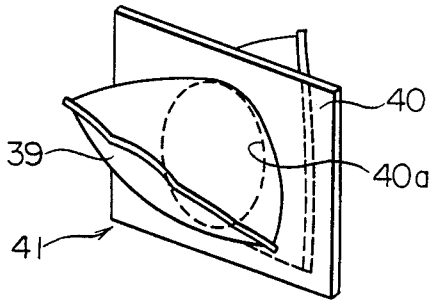
FIG. 19 is a perspective view showing the cushioning member of the eighth embodiment of the present invention.

FIGS. 18 and 19 are views showing the cushioning member of the eighth embodiment of the present invention. In this embodiment, the cushioning means 39 is formed into a baggy body having a polyhedral shape such as a triangular pyramid by means of, for example, a plastic film and the cavity portion 39*a* is formed in the inside, and, for example, gases such as air or gel-like liquids, or solids such as another cushioning means are filler in the cavity portion 39*a*. Further, in the supporting plate 40 which is formed by, for example, a corrugated fibreboard plate, a plastic plate and a veneer board, the punched hole 40*a* is matched to the shape of the cushioning means 39, or is formed into an optional shape, and as shown in FIG. 19, the cushioning member 41 is constituted by engaging the cushioning means 39 with the punched hole 40*a*.

Accordingly, also in this embodiment, it is possible to sufficiently obtain the cushioning property of the cushioning member 41 and to effectively absorb external shock. Further, the cushioning means 39 of this embodiment is also advantageous in cost because it can be continuously manufactured by mass production by means of, for example, a blow molding machine.

Figure 20:
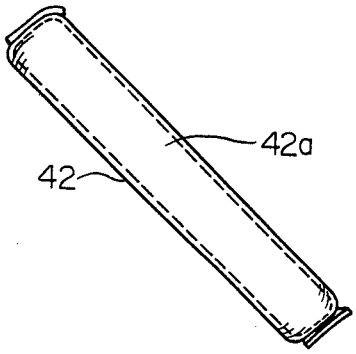
FIG. 20 is a perspective view showing the cushioning means of the ninth embodiment of the present invention.
Figure 21:
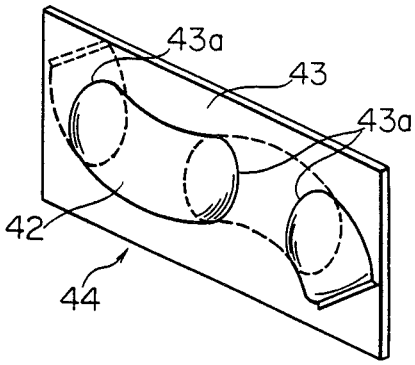
FIG. 21 is a perspective view showing the cushioning member of the ninth embodiment of present invention.

FIGS. 20 and 21 are views showing the cushioning member of the ninth embodiment of the present invention. In this embodiment, the cushioning member 44 is constituted by continuously inserting the baggy, cylindrical cushioning means 42, as shown in FIG. 20, which is formed by, for example, the plastic film, and in the inside of which the cavity portion 42*a* is formed, and in which, for example, gases such as air or gel-like liquids, or solids such as another cushioning means are filled in the cavity portion 42*a* into the punched hole 43*a* of the supporting plate 43, as shown in FIG. 21, which is formed by, for example, the corrugated fibreboard plate, the plastic plate and the veneer board, and causing the punched hole of the supporting plate to support the baggy, cylindrical cushioning means.

Whereby, in this embodiment, it is possible to obtain advantages similar to those of each embodiment mentioned above and to greatly improve the assembling efficiency of the cushioning member 44, and further the baggy, cylindrical cushioning means 42 is also advantageous in terms of cost, because it can be continuously manufactured by mass production by means of, for example, a blow molding machine.

Figure 22:
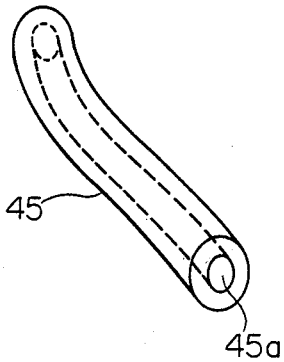
FIG. 22 is a perspective view showing the cushioning means of the tenth embodiment of the present invention.
Figure 23:
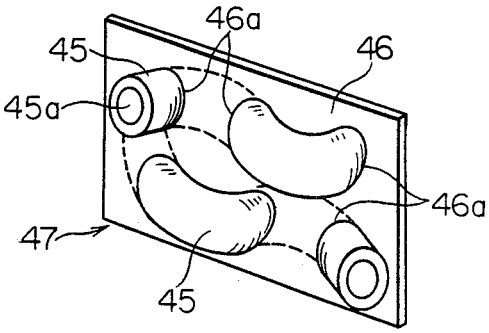
FIG. 23 is a perspective view showing the cushioning member of the tenth embodiment of the present invention.

FIGS. 22 and 23 are view showing the cushioning member of the tenth embodiment of the present invention. In this embodiment, the cushioning means 45 is formed into a cylindrical shape by means of, for example, the plastic foamed body, the rock cushioning member, rubber and cork, and the cavity portion 45*a* is formed in the cushioning means 45. And as shown in FIG. 23, the cushioning member 47 is constituted by continuously inserting the cushioning means into the punched hole 46*a* of the supporting plate 46 which is formed by, for example, the corrugated fibreboard plate, the plastic plate and the veneer board, and causing the punched hole in the supporting plate to support the cushioning means.

Accordingly, in this embodiment, it is also possible to optionally obtain the cushioning property of the cushioning member 47 and to effectively absorb external shock. Further, the cushioning means 45 of this embodiment is also advantageous in terms of cost because it can be continuously manufactured by mass production by means of, for example, an extrusion molding machine.

Figure 24:
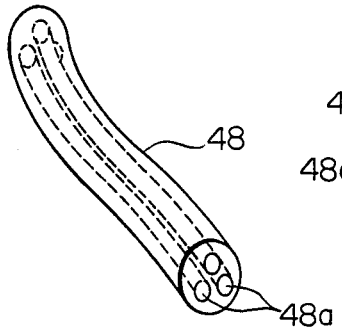
FIG. 24 is a perspective view showing the cushioning means of the eleventh embodiment of the present invention.
Figure 25:
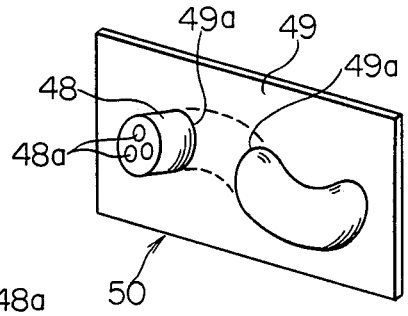
FIG. 25 is a perspective view showing the cushioning member of the eleventh embodiment of the present invention.

FIGS. 24 and 25 are views showing the cushioning member of the eleventh embodiment of the present invention. In this embodiment, the cushioning means 48 is formed into a cylindrical shape by means of, for example, a plastic foamed body, a rock cushioning member, and rubber and cork, and a plurality of cavity holes 48*a* are formed in the cushioning means 48. And as shown in FIG. 25, the cushioning member 50 is constituted by continuously inserting the cushioning means into the punched hole 49*a* of the supporting plate 40 which is formed, for example, by a corrugated fibreboard plate, the plastic plate and the veneer board, causing the punched hole of the supporting plate to support the cushioning means.

Accordingly, also in this embodiment, it is possible to optionally obtain the cushioning property of the cushioning member 50 and to effectively absorb external shock. Further, the cushioning means 48 of this embodiment is also advantageous in terms of cost because it can be continuously manufactured by mass production by means of, for example, an extrusion molding machine.

Figure 26:
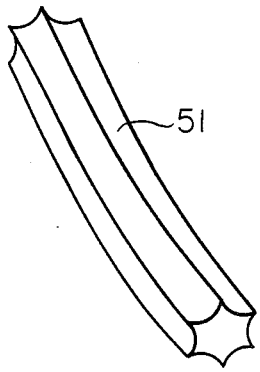
FIG. 26 is a perspective view showing the cushioning means of the twelfth embodiment of the present invention.
Figure 27:
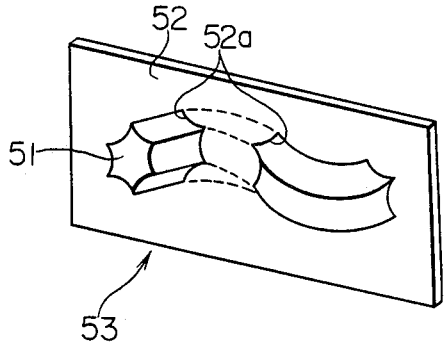
FIG. 27 is a perspective view showing the cushioning member of the twelfth embodiment of the present invention.

FIGS. 26 and 27 are views showing the cushioning member of the twelfth embodiment of the present invention. In this embodiment, the cushioning means 51 is formed into a polygonal shape such as, for example, and approximately hexagonal shape, by means of, for example, a plastic foamed body, rock cushioning member, rubber and cork. And as shown in FIG. 27, the cushioning member 53 is constituted by continuously inserting the cushioning means into the punched hole 49*a* formed for example, into a polygonal shape or a circular shape for the supporting plate 52 which is formed by, for example, a corrugated cardboard plate, a plastic plate and a veneer board, causing the punched hole of the supporting plate to support the cushioning means.

Accordingly, in this embodiment, it is also possible to optionally obtain the cushioning property of the cushioning member 53 and to effectively absorb external shock. Further, the cushioning means 51 of this embodiment is also advantageous in terms of cost, because it can be continuous manufactured by mass production by means of, for extrusion molding machine.

Figure 28:
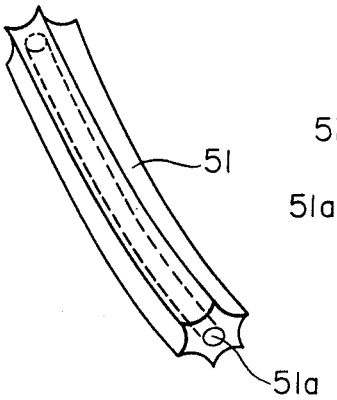
FIG. 28 is a perspective view showing the cushioning means of the thirteenth embodiment of the present invention.
Figure 29:
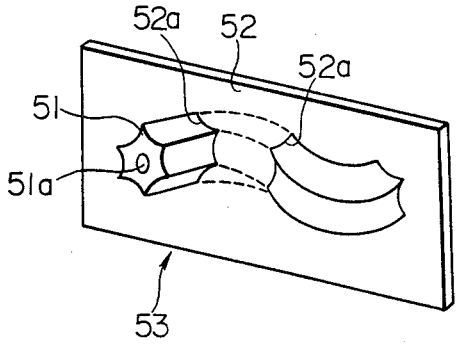
FIG. 29 is a perspective view showing the cushioning member of the thirteenth embodiment of the present invention.

Further, in the cushioning means 51 of the cushioning member 53 of the twelfth embodiment of FIGS. 26 and 27, one or more cavity holes 51*a* may be formed in the cushioning 51 which is formed into a polygonal shape such as an approximately hexagonal shape, as shown in FIG. 28 and 29 showing the cushioning member of the thirteenth embodiment of the present invention.

Figure 30:
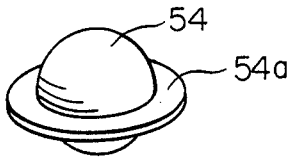
FIG. 30 is a perspective view showing the cushioning means of the fourteenth embodiment of the present invention.
Figure 31:
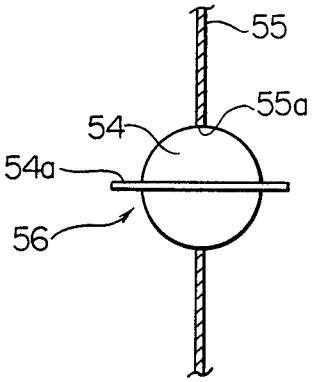
FIG. 31 is a partial sectional side view showing the cushioning member of the fourteenth embodiment of the present invention.

FIGS. 30 and 31 are views showing the cushioning member of the fourteenth embodiment of the present invention. In this embodiment, the cushioning means 54 is formed into a spherical shape by means of, for example, a foam-plastic body, a rock cushioning member, and rubber and cork, and the projection 54*a* of, for example, a ring-like rib is formed in the outer periphery of the cushioning means 54. And as shown in FIG. 31, the cushioning member 56 is constituted by inserting the cushioning means 54 into the punched hole 55*a* of the supporting plate 55 which is formed by, for example, a corrugated fibreboard plate, a plastic plate and a veneer board, and causing the punched hole of the supporting plate to support the cushioning means.

Accordingly, also in this embodiment, the cushioning property of the cushioning member 56 is improved by the projection 54*a* of the cushioning means 54 and it is possible to effectively absorb external shock which is given to the article.

Figure 32:
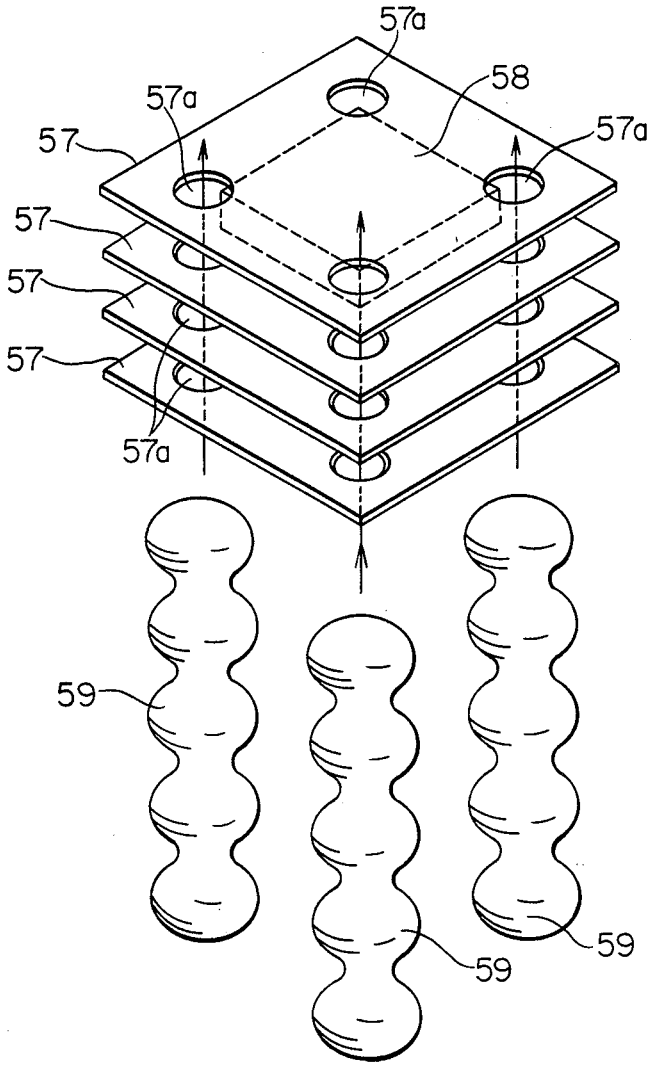
FIG. 32 is an exploded perspective view showing the fifteenth embodiment of the present invention.
Figure 33:
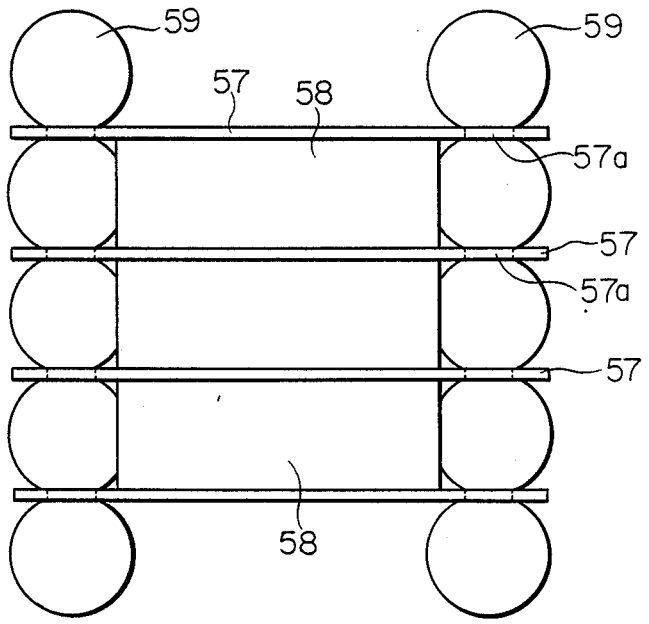
FIG. 33 is a side view of FIG. 32.

FIGS. 32 and 33 are views showing the fifteenth embodiment of the present invention. In this embodiment, the article is secured by sandwiching it by means of a plurality of supporting plate 57, 57 . . . which are formed by, for example a corrugated fibreboard plate, a plastic plate and a veneer board, and elongated, cushioning means 59, 59 . . . which are formed by, for example, a foam-plastic, a plastic plate, a rock cushioning member, and rubber and cork, and which are obtained by connecting a plurality of approximately spherical bodies with the opposite punched 57*a*, 57*a* . . . of the supporting plate 57, respectively.

Whereby, in this embodiment, it is possible to support the article and to protect it from shock without using a case body.

Figure 34:
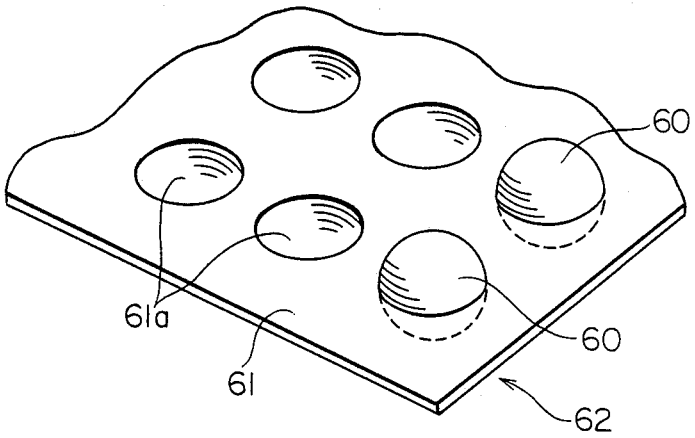
FIG. 34 is a perspective view showing the cushioning member of the sixteenth embodiment of the present invention.
Figure 35:
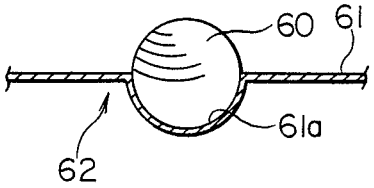
FIG. 35 is a partial side view of FIG. 34.

FIG. 34 and 35 are views showing the cushioning member of the sixteenth embodiment of the present invention. In this embodiment, the cushioning means 60 is into a spherical shape by means of, for example, a foam-plastic body, a rock cushioning member, and rubber, cork. Further, the supporting plate 61 is formed, for example, by corrugated fibreboard plate and foam plastic body, and which is formed with hemispherical concave portions 61*a*. And the cushioning member 62 is constituted by inserting the cushioning means 60 into each hemispherical concave portion 61*a* of the supporting plate 61, causing the hemispherical concave portions of the supporting plate to support the cushioning means.

Accordingly, also in this embodiment, it is possible to effectively absorb the external shock which is given to the article.

Figure 36:
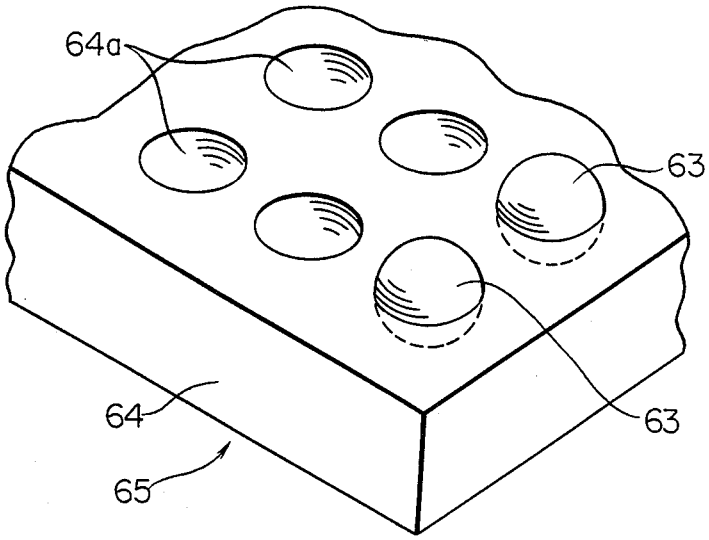
FIG. 36 is a perspective view showing the cushioning member of the seventeenth embodiment of the present invention.
Figure 37:
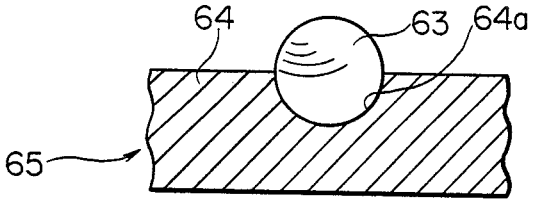
FIG. 37 is a partial sectional side view of FIG. 36.

FIGS. 36 and 37 are views showing the cushioning member of the seventeenth embodiment of the present invention. In this embodiment, the cushioning means 63 is formed into a spherical shape by means, for example, a foam-plastic body, a rock cushioning member, and rubber, cork. Further, the supporting means 64 is formed into a cubic shape by means of, for example, a foam-plastic body, and which is formed, for example, with hemispherical concave portions 64*a*. And the cushioning member 65 is constituted by inserting the cushioning means 63 into each hemispherical concave 64a of the supporting means 64, causing the hemispherical recess portions of the supporting means to support the cushioning means.

Accordingly, also in this embodiment, it is possible to effectively absorb external shock which is given to the article.

Further, the concave portions which are formed in the supporting plate and the supporting means of the sixteenth and the seventeenth embodiment in FIG. 34 to 37 may also be formed in convex portions or concave and convex portions.

Figure 38:
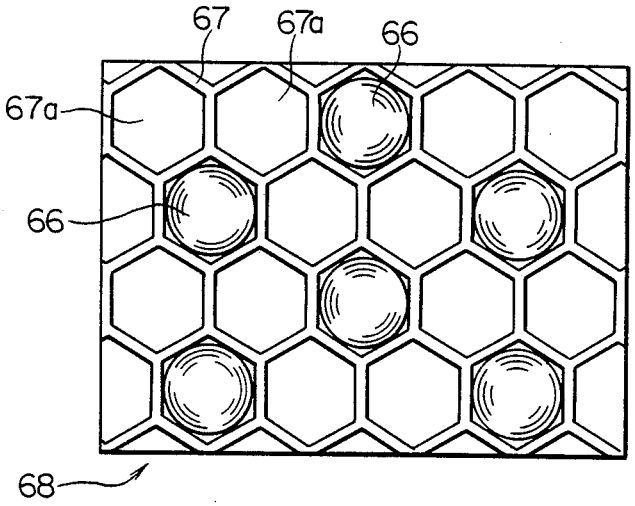
FIG. 38 is a plan view showing the cushioning member of the eighteenth embodiment of the present invention.
Figure 39:
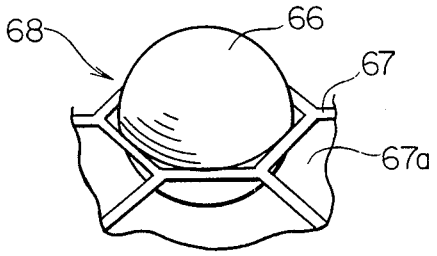
FIG. 39 is a perspective view showing the cushioning member of FIG. 38.

FIGS. 38 and 39 are views showing the cushioning member of the eighteen embodiment of the present invention. In this embodiment, the cushioning means 66 is formed into a spherical shape by means of, for example, a foam-plastic body, a rock cushioning member, and rubber, cork. Further, the supporting means 67 is formed into a circular or polygonal net state by means of, for example, plastic, metal or fiber, and which is formed with supporting holes 67a which are punched holes. And the cushioning member 68 is consititued by inserting the cushioning means 66 into each supporting hole 67a of the net state supporting means 67, and causing the supporting holes of the net state supporting means to support the cushioning means.

Accordingly, in this embodiment, it is possible to effectively absorb external shock which is given to the article by causing the supporting holes 67a of the net state supporting means 67 to easily support the spherical cushioning means 66 to constitute the cushioning member 68.

Further, in this embodiment, the entire article may be also wrapped by the cushioning member 68.

Figure 40:
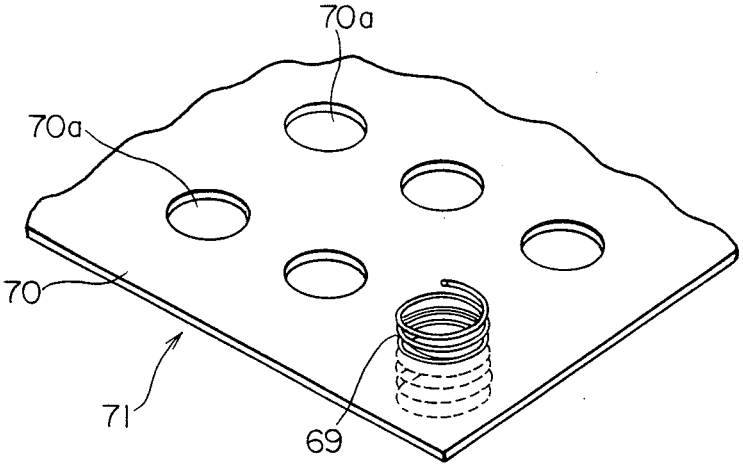
FIG. 40 is a perspective view showing the cushioning member of the nineteenth embodiment of the present invention.
Figure 41:
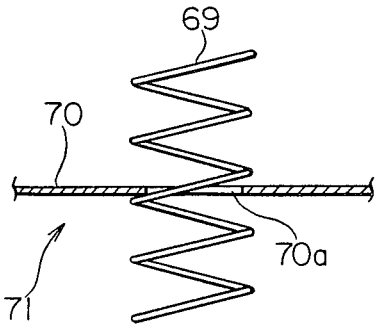
FIG. 41 is a partial sectional side view of FIG. 40.

FIG. 40 and 41 are views showing the cushioning member of the ninteenth embodiment of the present invention. In this embodiment the cushioning means 69 is formed into a coil shape or a spiral shape by means of, for example, plastic and metal. Futher, the supporting means 70 is formed into a plate shape by means of, for example, corrugated fibreboard, plastic, veneer and metal, and which is formed with the punched holes 70a. And the cushioning member 71 is constituted by inserting the coil-like cushioning means 69 into each punched hole 70a of the plate state supporting means 70, and causing the punched holes of the plate state supporting means to support the cushioning means.

Accordingly, in this embodiment, it is possible to effectively absorb external shock which is given to the article by causing the punched holes 70a of the plate state supporting means 70 to engage and support the coil-like cushioning means 69 to constitute the cushioning member 71.

Figure 42:
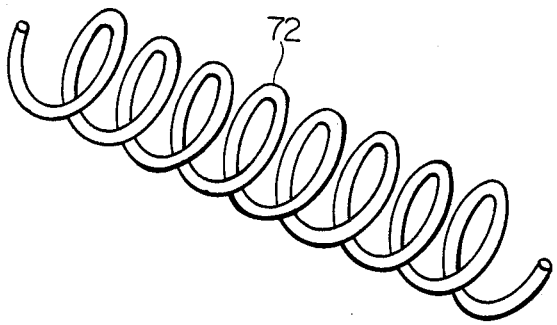
FIG. 42 is a perspective view showing the cushioning means of the twentieth embodiment of the present invention.
Figure 43:
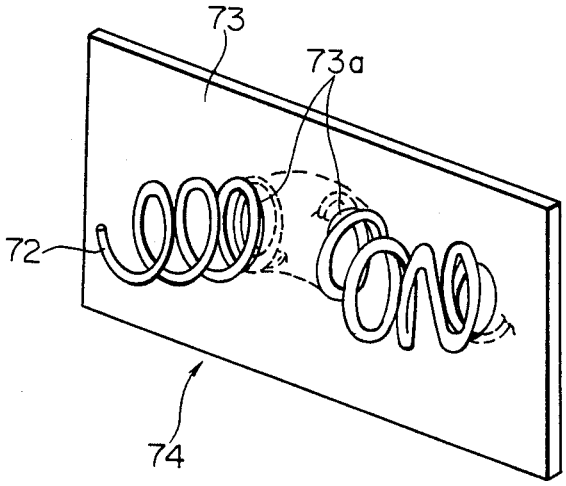
FIG. 43 is a perspective view showing the cushioning member of the twentieth embodiment of the present invention.

FIGS. 42 and 43 are views showing the cushioning member of the twentieth embodiment of the present invention. In this embodiment, the cushioning means 72 is formed into a coil shape or a spiral shape by means, for example, of plastic and metal or the like. Further, the supporting means 73 is formed into a plate shape by means of, for example, corrugated fibreboard, plastic, veneer and metal, and which is formed with a plurality of holes 73a. And the cushioning member 74 is constituted by continuously inserting the coil-like cushioning means 72 into a plurality of punched holes 73a of the plate state supporting means 73, and causing the punched holes of the plate state supporting means to support the cushioning means.

Accordingly, in this embodiment, it is possible to effectively absorb external shock which is given to the article by continuously inserting the coil-like cushioning means 72 into a plurality of punched 73a in the plate state supporting means 73, and causing the plurality of the punched holes 73a of the plate state supporting means to support the coil-like cushioning means to constitute the cushioning member 74.

Further, in each embodiment mentioned above, the case body may have a shape matching the shape of the article, such as a circular shape or a spherical shape, in addition to a box type. Furthermore, the supporting plate which is the supporting means may be separately used, matching to the size of the article, and therefore it is also possible to easily reuse the supporting plate because it can be separated.

As mentioned above, the present invention is possible to provide cushioning and protecting members for an article having a simple structure which can be cheaply and simply manufactured.

Further, it is possible to provide the cushioning and protecting members for an article which enable the cushioning means to sttached, and supported at the given places and the optinal places of the supporting means.

Furthermore, it is possible to provide the cushioning and protecting members for the article which enable the cushioning property to be improved by causing the cushioning means to make approximately point-contact with at least the article or the case body.

Furthermore, it is possible to provide the cushioning and protecting members for the article which can be reused and be used in optional places by causing the supporting means to be attached and detached, and support the cushioning means.

What is claimed is:

1. A cushioning and protecting device to be disposed between a case and an article to be contained in the case, comprising:

a substantially planar supporting plate having opposed first and second surfaces and including a plurality of spaced-apart holes extending therethrough;

a plurality of cushions insertable in said spaced-apart holes, said cushions protruding from said first and second surfaces when said cushions are inserted in said supporting plate, each of said cushions comprising a tubular film having a first seam and a second seam, said second seam being spaced longitudinally from said first seam and being substantially perpendicular to said first seam; and said supporting plate being insertable between the article and the case, said cushions engaging said article and said case when said supporting plate is inserted between the article and the case.

2. A device as claimed is claim 1, wherein said cushion is filled with a gel.

3. A cushioning and protecting device to be disposed between a case and an article to be contained in the case, comprising:

a substantially planar supporting plate having opposed first and second surfaces and including a plurality of spaced-apart holes extending therethrough;

a plurality of spherical cushions insertable in said spaced-apart holes, said cushions protruding from said first and second surfaces when said cushions are inserted in said supporting plate, each of said spherical cushions including a ring disposed about its outer circumference for engaging the case and the article; and said supporting plate being insertable between the article and the case, said spherical cushions engaging said article and said case when said supporting plate is inserted between the article and the case.

* * * * *